US011179831B2

(12) United States Patent
Zimmermann et al.

(10) Patent No.: US 11,179,831 B2
(45) Date of Patent: Nov. 23, 2021

(54) LOCKABLE DRIVE SOCKET ADAPTER

(71) Applicant: MILWAUKEE ELECTRIC TOOL CORPORATION, Brookfield, WI (US)

(72) Inventors: Michael J. Zimmermann, New Berlin, WI (US); James J. Van Essen, Hales Corners, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 315 days.

(21) Appl. No.: 16/505,900

(22) Filed: Jul. 9, 2019

(65) Prior Publication Data

US 2020/0016729 A1 Jan. 16, 2020

Related U.S. Application Data

(60) Provisional application No. 62/696,373, filed on Jul. 11, 2018.

(51) Int. Cl.
*B25B 23/00* (2006.01)
*B25B 21/00* (2006.01)

(52) U.S. Cl.
CPC ..... *B25B 23/0035* (2013.01); *B25B 21/007* (2013.01)

(58) Field of Classification Search
CPC ..... B25B 23/0035; B25B 21/007
See application file for complete search history.

(56) References Cited

U.S. PATENT DOCUMENTS

| | | | | |
|---|---|---|---|---|
| 6,386,789 | B1 * | 5/2002 | Chausse | F16B 21/165 403/322.2 |
| 6,543,959 | B1 * | 4/2003 | Jore | B25B 23/0035 279/30 |
| 7,195,247 | B2 * | 3/2007 | Shu | B25B 23/0035 279/22 |
| 7,469,909 | B2 * | 12/2008 | Strauch | B25B 23/0035 279/75 |
| 8,215,208 | B2 * | 7/2012 | Blackston | B25B 13/481 81/177.75 |
| 8,813,614 | B2 * | 8/2014 | Crewe | B25B 15/001 81/439 |
| 9,067,266 | B2 * | 6/2015 | Puzio | B23B 31/107 |
| 10,259,107 | B2 * | 4/2019 | Wang | B25B 23/12 |

* cited by examiner

*Primary Examiner* — David B. Thomas
(74) *Attorney, Agent, or Firm* — Michael Best & Friedrich LLP

(57) ABSTRACT

A lockable adapter is configured to selectively couple a drive socket to a power tool. The lockable adapter includes a shaft configured to couple the lockable adapter to the power tool for the power tool to rotate the lockable adapter about an axis, a drive member movable along the axis relative to the shaft, and a retaining member supported by the drive member. The drive member is configured to interface with the drive socket to support the drive socket on the lockable adapter. When the lockable adapter is in a locked state, a portion of the retaining member protrudes beyond a surface of the drive member such that the retaining member is configured to secure the drive socket to the drive member. When the lockable adapter is in an unlocked state, the retaining member is configured to allow for removal of the drive socket from the drive member.

21 Claims, 4 Drawing Sheets

LOCKABLE DRIVE SOCKET ADAPTER

CROSS-REFERENCE TO RELATED APPLICATIONS

This application claims priority to U.S. Provisional Patent Application No. 62/696,373, filed Jul. 11, 2018, the entire contents of which are hereby incorporated by reference.

BACKGROUND

The present application relates to a drive socket adapter that selectively couples a drive socket or the like to a power tool.

SUMMARY

In one aspect, the invention provides a lockable adapter configured to selectively couple a drive socket to a power tool. The lockable adapter includes a shaft configured to couple the lockable adapter to the power tool for the power tool to rotate the lockable adapter about an axis and a drive member movable relative to the shaft. The drive member is configured to interface with the drive socket to support the drive socket on the lockable adapter. The lockable adapter also includes a retaining member supported by the drive member. When the lockable adapter is in a locked state, a portion of the retaining member protrudes beyond a surface of the drive member such that the retaining member is configured to secure the drive socket to the drive member. When the lockable adapter is in an unlocked state, the retaining member is configured to allow for removal of the drive socket from the drive member.

In another aspect, the invention provides a lockable adapter configured to selectively couple a drive socket to a power tool. The lockable adapter includes a shaft configured to couple the lockable adapter to the power tool for the power tool to rotate the lockable adapter about an axis and a drive member moveable relative to the shaft. The drive member is configured to interface with the drive socket to support the drive socket on the lockable adapter. The lockable adapter also includes a collar moveable relative to the shaft. The lockable adapter moves into a locked state configured to lock the drive socket to the lockable adapter in response to inserting the drive socket onto the drive member. The lockable adapter moves into an unlocked state configured to allow removal of the drive socket from the lockable adapter in response to actuating the collar.

In yet another aspect, the invention provides a method of operating a lockable adapter selectively coupled to a power tool. The lockable adapter includes a shaft selectively coupled to the power tool, a drive member movable along the shaft, and a collar movable along the shaft. The method includes inserting a drive socket onto the drive member, moving the lockable adapter into a locked state in which the drive socket is secured to the drive member in response to inserting the drive socket onto the drive member, and moving the lockable adapter into an unlocked state in which the drive socket is allowed to be removed from the drive member in response to actuating the collar relative to the shaft.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Terms of degree, such as "substantially," "about," "approximately," etc. are understood by those of ordinary skill to refer to reasonable ranges outside of the given value, for example, general tolerances associated with manufacturing, assembly, and use of the described embodiments.

DETAILED DESCRIPTION

Figure 1:
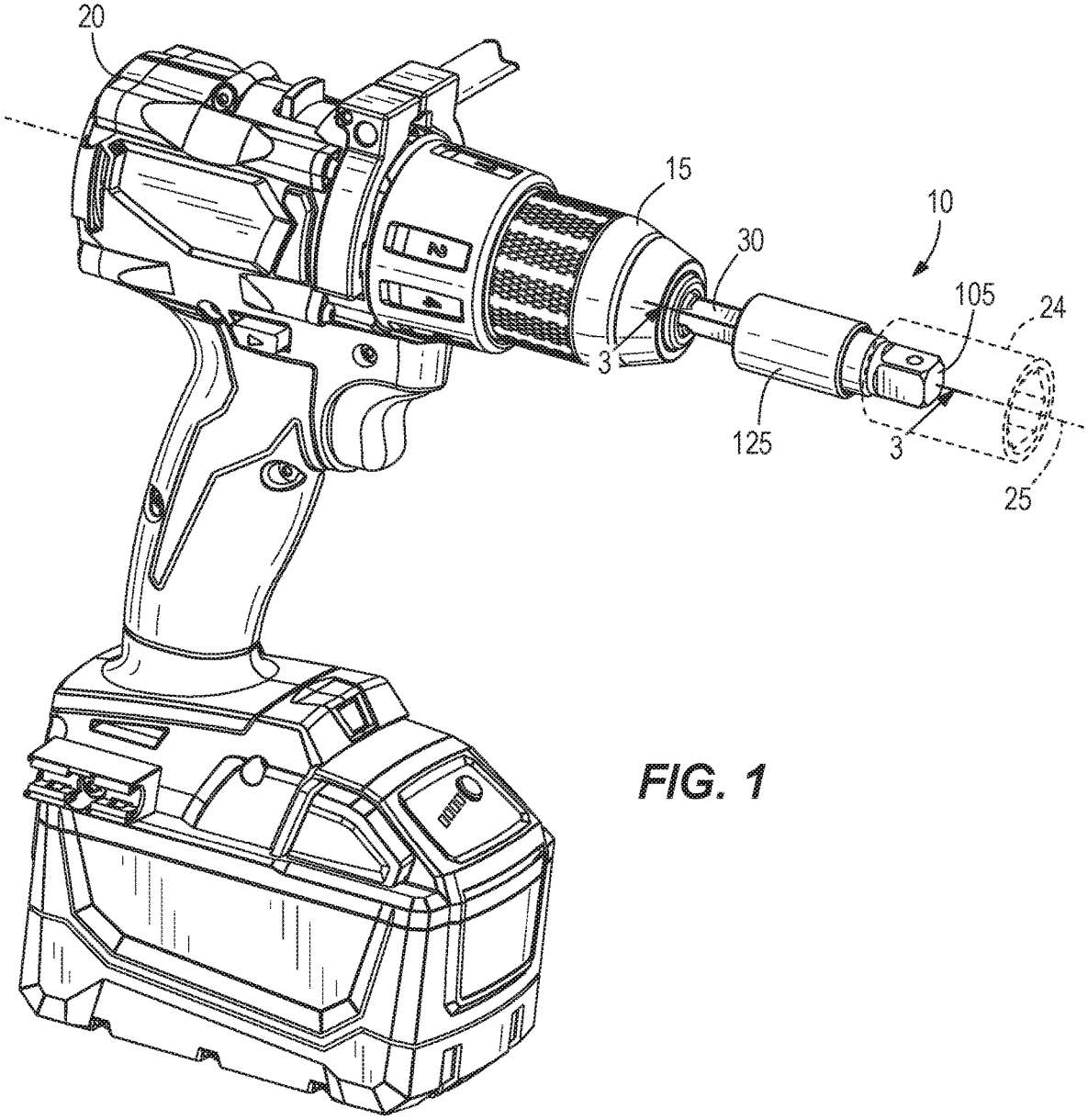
FIG. 1 is a perspective view of a lockable drive socket adapter according to one embodiment of the invention, the lockable drive socket adapter coupled to a power tool.

FIG. 1 illustrates a lockable drive socket adapter 10 selectively coupled to a chuck 15 of a power tool 20. The illustrated power tool 20 is a power drill, but in other embodiments, the power tool 20 can be an impact drill or other rotary power tools. When the adapter 10 is coupled to the chuck 15, the power tool 20 is operable to move the adapter 10—and ultimately a drive socket 24 (FIG. 3) coupled to the adapter 10—about a rotational axis 25.

Figure 2:
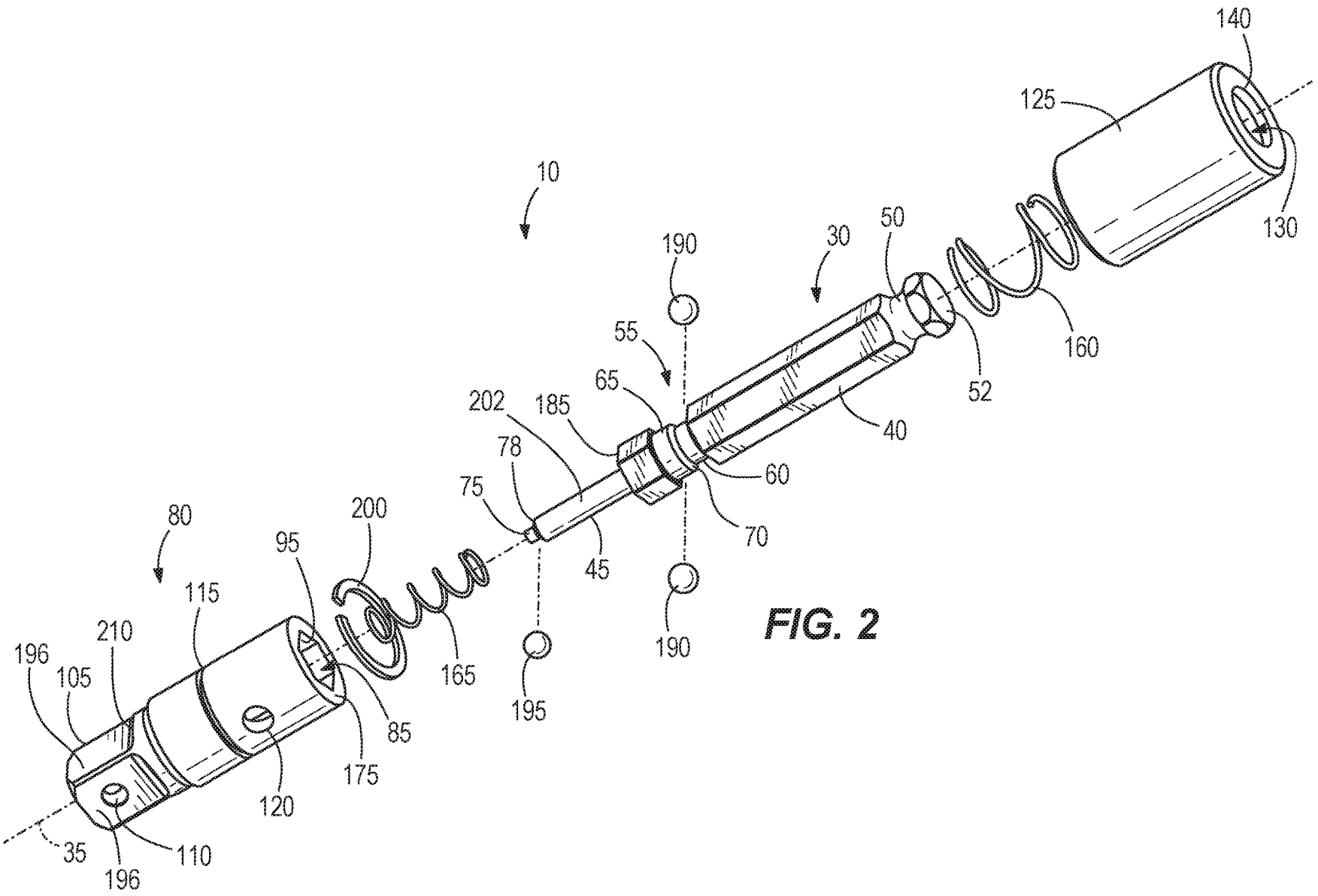
FIG. 2 is an exploded view of the lockable drive socket adapter.
Figure 3:
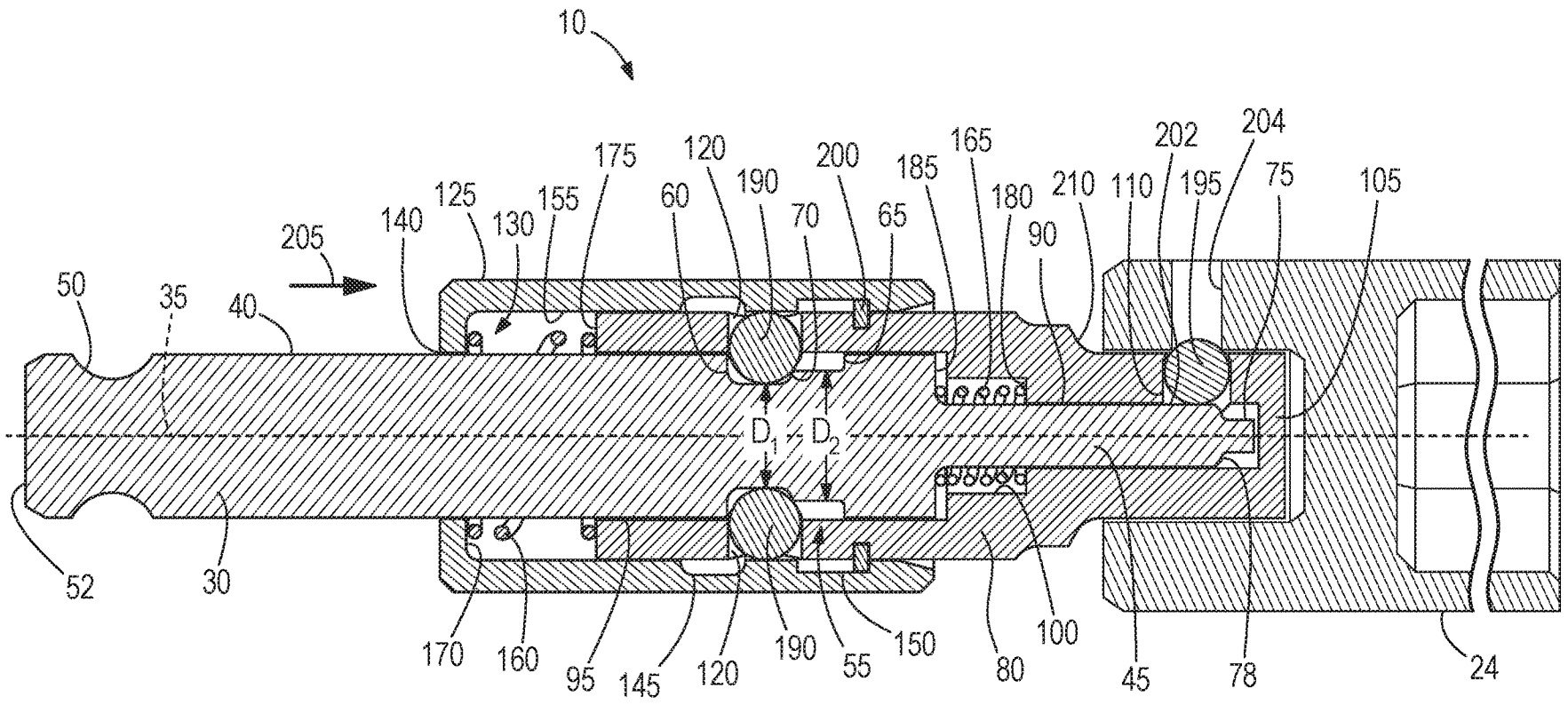
FIG. 3 is a cross-sectional view of the lockable drive socket adapter along line 3-3 of FIG. 1 when the lockable drive socket adapter is in a locked position.

With reference to FIG. 2, the adapter 10 includes a shaft 30 having a longitudinal axis 35, a hexagonal drive portion or body 40 that engages the chuck 15 of the power tool 20, and a projection 45 extending from the body 40. In the illustrated embodiment, the body 40 includes an annular groove 50 adjacent an end 52 of the body 40 adapted to interface with the chuck 15 (e.g., a quick release chuck), allowing the adapter 10 to be quickly secured to or released from the chuck 15. In other embodiments, the groove 50 can be omitted. In some embodiments, at least a portion of the body 40 can be sized as a ¼ inch hexagonal shank, a 7/16 inch hexagonal shank, and the like. The illustrated body 40 also includes a variable depth groove 55 (e.g., a stepped groove) having a first groove 60 with a first diameter $D_1$ (e.g., a first radial dimension; FIG. 3), a second groove 65 with a second diameter $D_2$ (e.g., a second radial dimension; FIG. 3), and a step 70 positioned between the first and second grooves 60, 65. The second groove 65 is positioned closer to the projection 45 than the first groove 60 in a direction along the longitudinal axis 35, and the first diameter $D_1$ is smaller than the second diameter $D_2$. In other embodiments, the first and second grooves 60, 65 can be different sized apertures or detents on the shaft 30. In addition, the illustrated projection 45 of the shaft 30 is substantially cylindrical and includes a tip 75 having a step 78.

The illustrated adapter 10 also includes a sleeve 80 (e.g., a drive member) having a cavity 85 that receives a portion of the body 40 and the projection 45. With reference to FIG. 3, the cavity 85 includes a first portion 90 sized to receive the projection 45, a second portion 95 sized to receive a portion of the body 40, and a third portion 100 positioned between the first and second portions 90, 95. In other embodiments, the sleeve 80 can include the first and second portions 90, 95 and omit the third portion 100. With reference back to FIG. 2, inner walls of the sleeve 80 that form the second portion 95 are hexagonally shaped to match the hexagonal shape of the body 40. As such, the sleeve 80 is inhibited from rotating relative to the shaft 30 about the longitudinal axis 35 when the body 40 is received within the second portion 95 of the cavity 85.

With continued reference to FIG. 2, the illustrated sleeve 80 also includes a drive protrusion 105 having a retaining aperture 110, an annular groove 115, and a pair of locking apertures 120 (only one aperture 120 is shown in FIG. 2). In the illustrated embodiment, the drive protrusion 105 has a generally square cross-section such that the drive protrusion 105 may be referred to as a square drive protrusion. In some embodiments, the square drive protrusion 105 can be a ⅜ inch square protrusion, a ½ inch square protrusion, and the like. In the illustrated embodiment, the pair of locking apertures 120 are spaced 180 degrees relative to each other about the axis 35. In other embodiments, the sleeve 80 can include one locking aperture 120 or more than two locking apertures 120. Also, the illustrated annular groove 115 is positioned between the pair of locking apertures 120 and the square drive protrusion 105 in the direction along the longitudinal axis 35. In other embodiments, the pair of locking apertures 120 can be positioned between the annular groove 115 and the square drive protrusion 105 in the direction along the longitudinal axis 35.

With reference to FIGS. 2 and 3, the illustrated adapter 10 further includes a collar 125 having a cavity 130 that receives portions of the sleeve 80 and the shaft 30. The body 40 of the shaft 30 also extends through a rear collar aperture 140 of the collar 125. In one embodiment, the collar aperture 140 can be hexagonally shaped to match the hexagonal shape of the shaft 30 so that the collar 125 is inhibited from rotating relative to the shaft 30 (and the sleeve 80) about the longitudinal axis 35 and to inhibit dirt and debris from entering the cavity 130 between the shaft 30 and the collar 125. The illustrated collar 125 includes a first annular groove 145 and a second annular groove 150 formed into an inner surface 155 of the collar 125. In the illustrated embodiment, the grooves 145, 150 extend 360 degrees around the inner surface 155. In other embodiments, the grooves 145, 150 can extend less than 360 degrees around the inner surface 155 (e.g., the grooves 145, 150 can be discrete detents).

Figure 4:
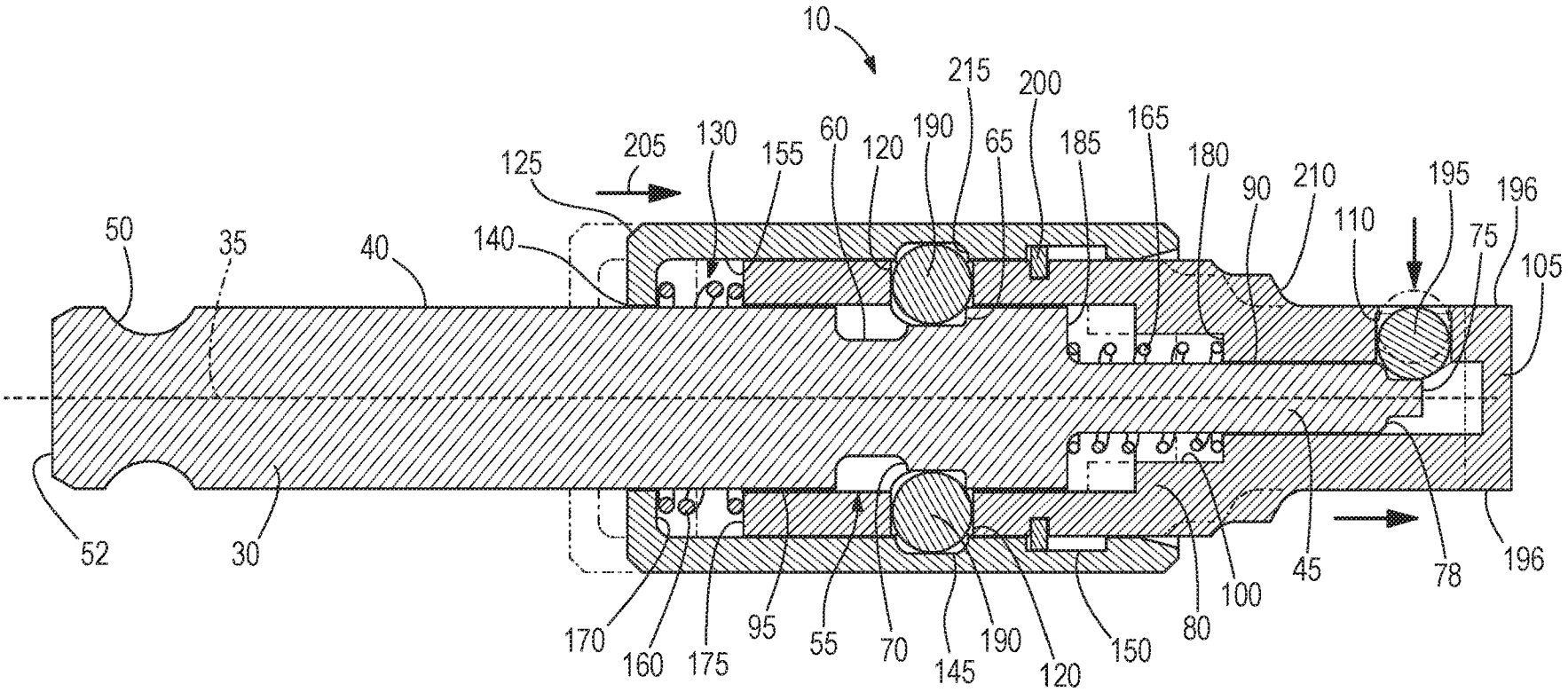
FIG. 4 is a cross-sectional view of the lockable drive socket adapter along line 3-3 of FIG. 1 when the lockable drive socket adapter is in an unlocked position.

As best shown in FIGS. 3 and 4, the collar 125 and the sleeve 80 are axially biased relative to each other along the longitudinal axis 35 by a first biasing member 160. In the illustrated embodiment, the first biasing member 160 is a first coil spring. In other embodiments, the first biasing member 160 may include other types of spring elements. The sleeve 80 and the shaft 30 are axially biased relative to each other along the longitudinal axis 35 by a second biasing member 165. In the illustrated embodiment, the second biasing member 165 is a second coil spring. In other embodiments, the second biasing member 165 may include other types of spring elements. In particular, the first biasing member 160 extends around the body 40 of the shaft 30 and contacts a bottom surface 170 of the collar 125 and a rear surface 175 of the sleeve 80 to bias the bottom surface 170 and the rear surface 175 away from each other. The second biasing member 165 extends around the projection 45 of the shaft 30 and contacts an inner wall 180 of the sleeve 80 and a front surface 185 of the body 40 to bias the inner wall 180 and the front surface 185 away from each other.

Locking members 190 are each received within one locking aperture 120 of the sleeve 80 and the variable depth groove 55 of the shaft 30 (FIGS. 3 and 4). In the illustrated embodiment, the locking members 190 are ball bearings or locking spheres, but may alternatively be other types of suitable locking members. As discussed in more detail below, the locking members 190 can also be received within the first annular groove 145 of the collar 125 when the adapter 10 is in an unlocked state (FIG. 4). Furthermore, a retaining member 195 is received within the retaining aperture 110 of the square drive protrusion 105. In the illustrated embodiment, the retaining member 195 is a ball bearing or retaining sphere, but may alternatively be another type of suitable retaining member. The retaining aperture 110 is sized such that only a portion of the retaining member 195 can extend beyond a planar surface 196 (e.g., an outer surface) of the square drive protrusion 105 (as shown in FIG. 3).

With continued reference to FIGS. 3 and 4, a retaining ring 200 is axially fixed within the annular groove 115 of the sleeve 80, but is axially moveable within the second annular groove 150 of the collar 125. As such, the retaining ring 200 restricts axially movement of the collar 125 relative to the sleeve 80 by the retaining ring 200 abutting ends of the second annular groove 150.

FIG. 3 illustrates a locked state of the adapter 10. In the locked state, the drive socket 24 is secured to the square drive protrusion 105 to inhibit the drive socket 24 from being removed from the adapter 10. In particular, the retaining member 195 is in contact with an outer surface 202 of the projection 45 for the shaft 30 to position the portion of the retaining member 195 beyond the planar surface 196 (FIG. 2) of the square drive protrusion 105. As such, the portion of the retaining member 195 is received within a groove 204 of the drive socket 24 to inhibit the drive socket 24 from sliding off and being removed from the square drive protrusion 105. Also in the locked state, the sleeve 80 is axially locked relative to the shaft 30 to maintain the portion of the retaining member 195 above the planar surface 196 of the square drive protrusion 105. Specifically, a portion of the inner surface 155 of the collar 125 engages the locking members 190 to locate the locking members 190 within the first groove 60 of the variable depth groove 55 (e.g., the locking members 190 are captured between the inner surface 155, the corresponding locking aperture 120, and the first groove 60). Consequently, the sleeve 80 is axially locked relative to the shaft 30 as axial movement of the sleeve 80 (e.g., in a forward direction 205 away from the end 52 of the shaft 30) is blocked by walls of the locking apertures 120 pushing (via the biasing force of the second biasing member 165) the locking members 190 against the step 70. As such, the second biasing member 165 is in a compressed configuration between the sleeve 80 and the shaft 30 when the adapter 10 is in the locked state. Furthermore in the locked state, the first biasing member 160 biases the collar 125 in a rearward direction opposite the forward direction 205 such that the retaining ring 200 engages a forward end of the second annular groove 150.

To move the adapter 10 from the locked state (FIG. 3) to the unlocked state (FIG. 4), allowing the drive socket 24 to be removed from the adapter 10, the collar 125 is axially moved relative to the shaft 30 in the forward direction 205. This movement allows the first annular groove 145 of the collar 125 to align with the locking members 190, creating enough clearance for the locking members 190 to move radially outward and away from the first groove 60 of the variable depth groove 55. For example, the collar 125 is moved into a position where the first groove 60, the locking apertures 120, and the first annular groove 145 radially align with each other. Thereafter, the sleeve 80 and the shaft 30 are axially unlocked relative to each other, allowing the biasing force of the second biasing member 165 to be released to push the sleeve 80 in the forward direction 205 relative to the shaft 30. Consequently, the locking members 190 are pushed over the step 70 to be positioned within the second groove 65 and within the first annular groove 145 by the movement of the sleeve 80. In addition, the retaining aperture 110 radially aligns with the tip 75 of the shaft 30. This allows enough clearance for the retaining member 195 to partially move into the first cavity 90 of the sleeve 80, leaving little to no portion of the retaining member 195 extending beyond the planar surface 196 of the square drive protrusion 105 (FIG. 4). Accordingly, the drive socket 24 can slide off and be removed from the square drive protrusion 105.

To again couple the drive socket 24 to the adapter 10, the adapter 10 is positioned within the unlocked state (FIG. 4) and the drive socket 24 is slid onto the square drive protrusion 105. Eventually, a rear edge of the drive socket 24 comes into contact with a flange 210 of the sleeve 80, causing the drive socket 24 to push the sleeve 80 in the rearward direction. Such movement of the sleeve 80 and the drive socket 24 also radially moves the retaining member 195 relative to the retaining aperture 110. In particular, the movement of the sleeve 80 relative to the shaft 30 in the rearward direction causes the sleeve 80 to push the retaining member 195 against the step 78 of the shaft 30 for the retaining member 195 to ride up onto the outer surface 202 of the projection 45. As such, the portion of the retaining member 195 extends beyond the outer surface 202 of the square drive protrusion 105 to be received within the groove 204 of the drive socket 24, as illustrated in FIG. 3.

With continued movement of the sleeve 80 and the drive socket 24 in the rearward direction (against the biasing force of the second biasing member 165), the sleeve 80 pushes the locking members 190 out of the second groove 65 and back toward the first groove 60. The collar 125 also moves with the sleeve 80 in the rearward direction by the biasing force of the first biasing member 160 (e.g., a portion of the locking members 190 positioned within the first annular groove 145 maintains radial alignment of the locking apertures 120 and the first annular groove 145). Eventually, the first annular groove 145, the locking apertures 120, and the first groove 60 of the shaft 30 come into radial alignment, allowing the locking members 190 to be received within the first groove 60. To then relock the adapter 10 (FIG. 3), the sleeve 80 is further moved in the rearward direction by the drive socket 24 for an edge 215 (FIG. 4) of the first annular groove 145 to push the locking members 190 into the first groove 60, allowing the inner surface 155 of the collar 125 to slide over the locking members 190 and position the adapter 10 in the locked state.

As such, the drive socket 24 can be coupled to the adapter 10 through single-handed operation (e.g., simply by pushing the drive socket 24 onto the drive protrusion 105), without requiring a user to manually manipulate the sleeve 80 or the collar 125. In other words, the drive socket 24 is automatically locked to the adapter 10 by simply inserting the drive socket 24 onto the adapter 10. The adapter 10 remains biased in the locked stated (FIG. 3) until the collar 125 is manually actuated to bias the sleeve 80 forward. The adapter 10 then remains biased in the unlocked state (FIG. 4) until the drive socket 24 is pushed onto the sleeve 80. In other embodiments, the drive member 80 can be a socket that receives a drive member (e.g., a screwdriver bit, etc.) to couple the drive member to the power tool 20 with the lockable adapter 10 actuated in a similar manner as described above to lock or unlock the drive member to the adapter 10.

Although the invention has been described in detail with reference to certain preferred embodiments, variations and modifications exist within the scope and spirit of one or more independent aspects of the invention as described. Various features and advantages of the disclosure are set forth in the following claims.

The invention claimed is:

1. A lockable adapter configured to selectively couple a drive socket to a power tool, the lockable adapter comprising:

a shaft configured to couple the lockable adapter to the power tool for the power tool to rotate the lockable adapter about an axis;

a drive member movable relative to the shaft, the drive member configured to interface with the drive socket to support the drive socket on the lockable adapter; and a retaining member supported by the drive member, wherein when the lockable adapter is in a locked state, a portion of the retaining member protrudes beyond a surface of the drive member such that the retaining member is configured to secure the drive socket to the drive member, and wherein when the lockable adapter is in an unlocked state, the retaining member is configured to allow for removal of the drive socket from the drive member.

2. The lockable adapter of claim 1, further comprising a collar including a cavity that receives a portion of the drive member and a portion of the shaft, wherein the collar is in a first position relative to the drive member when the lockable adapter is in the locked state, and wherein the collar is in a second position relative to the drive member when the lockable adapter is in the unlocked state.

3. The lockable adapter of claim 2, wherein the drive member includes an aperture that receives a locking member to locate the locking member between the collar and the shaft, and wherein the shaft includes a variable depth groove that receives the locking member.

4. The locking adapter of claim 3, wherein the variable depth groove includes a first groove having a first radial dimension and a second groove having a second radial dimension different than the first radial dimension, wherein the locking member is received within the first groove when the lockable adapter is in the locked state, and wherein the locking member is received within the second groove when the lockable adapter is in the unlocked state.

5. The locking adapter of claim 4, wherein the first radial dimension is less than the second radial dimension.

6. The locking adapter of claim 1, further comprising a collar including a cavity that receives a portion of the drive member and a portion of the shaft, wherein a biasing member is positioned between the collar and the drive member to bias the lockable adapter in the locked state.

7. The lockable adapter of claim 1, further comprising a biasing member positioned between the shaft and the drive member, wherein the biasing member holds the lockable adapter in the unlocked state.

8. A lockable adapter configured to selectively couple a drive socket to a power tool, the lockable adapter comprising:

a shaft configured to couple the lockable adapter to the power tool for the power tool to rotate the lockable adapter about an axis;

a drive member moveable relative to the shaft, the drive member configured to interface with the drive socket to support the drive socket on the lockable adapter; and a collar moveable relative to the shaft, wherein the lockable adapter moves into a locked state configured to lock the drive socket to the lockable adapter in response to inserting the drive socket onto the drive member, and wherein the lockable adapter moves into an unlocked state configured to allow removal of the drive socket from the lockable adapter in response to actuating the collar.

9. The lockable adapter of claim 8, further comprising a first biasing member positioned between the collar and the drive member, wherein the first biasing member biases the lockable adapter in the locked state.

10. The lockable adapter of claim 9, further comprising a second biasing member positioned between the shaft and the drive member, wherein the second biasing member biases the lockable adapter in the unlocked state.

11. The lockable adapter of claim 8, wherein the drive member includes an aperture that receives a locking member to locate the locking member between the collar and the shaft, and wherein the shaft includes a variable depth groove that receives the locking member.

12. The locking adapter of claim 11, wherein the variable depth groove includes a first groove having a first radial dimension and a second groove having a second radial dimension different than the first radial dimension, wherein the locking member is received within the first groove when the lockable adapter is in the locked state, and wherein the locking member is received within the second groove when the lockable adapter is in the unlocked state.

13. The locking adapter of claim 12, wherein the first radial dimension is less than the second radial dimension.

14. The lockable adapter of claim 8, further comprising a retaining member supported by the drive member, wherein the shaft engages the retaining member such that a portion of the retaining member protrudes beyond a surface of the drive member when the lockable adapter is in the locked state.

15. The lockable adapter of claim 8, wherein the drive member includes a square drive protrusion configured to be received within the drive socket.

16. The lockable adapter of claim 8, wherein the lockable adapter remains in the unlocked position after the collar is actuated.

17. A method of operating a lockable adapter selectively coupled to a power tool, the lockable adapter including a shaft selectively coupled to the power tool, a drive member movable along the shaft, and a collar movable along the shaft, the method comprising:

inserting a drive socket onto the drive member;

moving the lockable adapter into a locked state in which the drive socket is secured to the drive member in response to inserting the drive socket onto the drive member; and moving the lockable adapter into an unlocked state in which the drive socket is allowed to be removed from the drive member in response to actuating the collar relative to the shaft.

18. The method of claim 17, wherein moving the lockable adapter into the locked state further includes moving the drive member relative to the shaft toward the power tool in response to inserting the drive socket onto the drive member.

19. The method of claim 18, further comprising moving a retaining member that secures the drive socket to the drive member by the shaft in response to moving the drive member relative to the shaft.

20. The method of claim 17, wherein moving the lockable adapter into the unlocked state further includes moving the collar relative to the shaft away from the power tool.

21. The method of claim 20, further comprising biasing the drive member away from the power tool by a biasing member such that the lockable adapter is held in the unlocked position.

* * * * *